US008991970B2

(12) United States Patent
Ito

(10) Patent No.: US 8,991,970 B2
(45) **Date of Patent: *Mar. 31, 2015**

(54) PRINTING DEVICE, DISCHARGE TEST DEVICE AND DISCHARGE TEST METHOD

(71) Applicant: Seiko Epson Corporation, Tokyo (JP)

(72) Inventor: Sukehiro Ito, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/079,951

(22) Filed: Nov. 14, 2013

(65) Prior Publication Data

US 2014/0071193 A1 Mar. 13, 2014

Related U.S. Application Data

(63) Continuation of application No. 13/759,668, filed on Feb. 5, 2013, now Pat. No. 8,608,270, which is a continuation of application No. 12/917,098, filed on Nov. 1, 2010, now Pat. No. 8,388,089.

(30) Foreign Application Priority Data

Nov. 13, 2009 (JP) ..... 2009-259689

(51) Int. Cl.

| | |
|---|---|
| ***B41J 2/165*** | (2006.01) |
| ***B41J 29/393*** | (2006.01) |
| ***B41J 2/12*** | (2006.01) |
| ***B41J 2/045*** | (2006.01) |

(52) U.S. Cl.

CPC ..... *B41J 2/12* (2013.01); *B41J 2/16579* (2013.01); *B41J 2/04563* (2013.01)

USPC ..... 347/19; 347/23

(58) Field of Classification Search

CPC ..... B41J 29/38; B41J 29/393; B41J 2/135

USPC ..... 347/19, 23

See application file for complete search history.

(56) References Cited

U.S. PATENT DOCUMENTS

| | | | | |
|---|---|---|---|---|
| 6,505,907 | B2 | 1/2003 | Ishinaga et al. | |
| 6,612,677 | B2 | 9/2003 | Su et al. | |
| 8,608,270 | B2 * | 12/2013 | Ito | 347/14 |
| 2002/0021315 | A1 | 2/2002 | Sato et al. | |
| 2009/0066743 | A1 | 3/2009 | Komatsu et al. | |

FOREIGN PATENT DOCUMENTS

| | | | |
|---|---|---|---|
| JP | 2003-053949 | A | 2/2003 |

* cited by examiner

*Primary Examiner* — Jason Uhlenhake

(57) ABSTRACT

A printing device or discharge test device comprising a head that includes a nozzle discharging liquid to a medium, a temperature obtaining section that obtains a temperature related to the head, a missing-dot detecting section that detects whether or not the liquid is discharged from the nozzle, and a control section that controls the head and the missing-dot detecting section. When the temperature obtained is within a first temperature range, the head is configured to discharge the liquid to the medium and whether or not the liquid is discharged from the nozzle is detected. No such detection is made at other temperatures. When the temperature obtained is outside the first temperature range and within a second temperature range, the head is configured to discharge the liquid to the medium, and when the temperature obtained is outside the second temperature range, the liquid is not discharged to the medium.

8 Claims, 7 Drawing Sheets

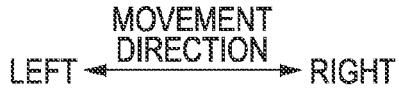
FIG. 3A
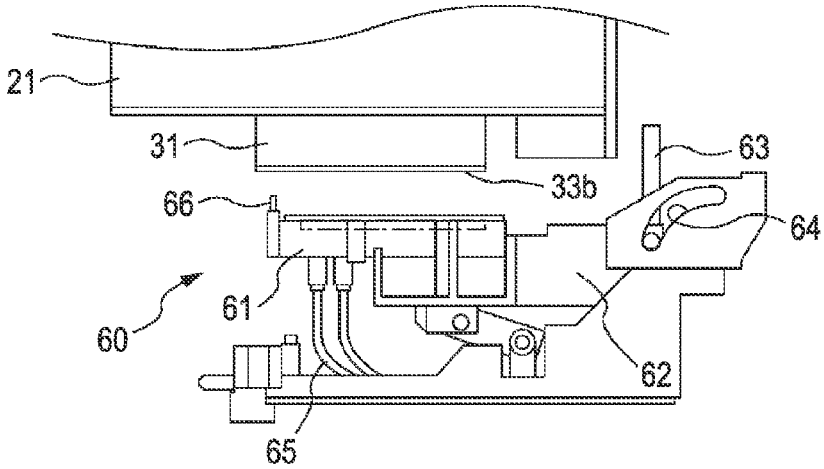
FIG. 3B
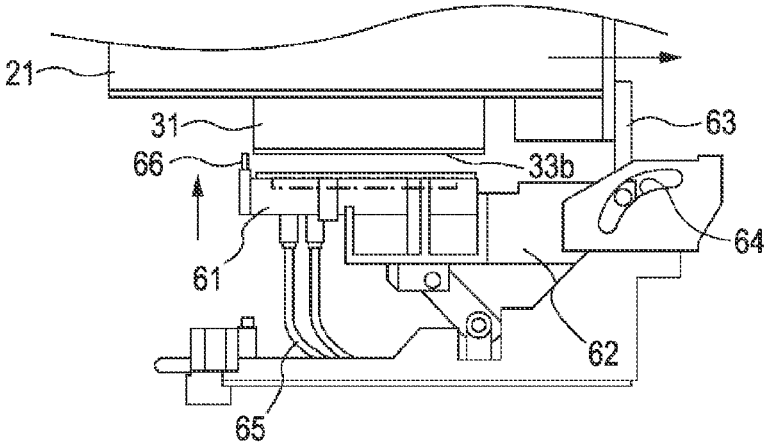
FIG. 3C
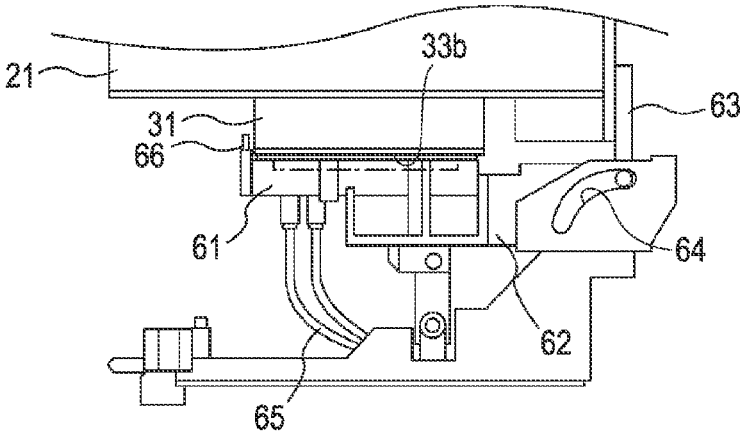

PRINTING DEVICE, DISCHARGE TEST DEVICE AND DISCHARGE TEST METHOD

CROSS-REFERENCE TO RELATED APPLICATIONS

This application is a continuation of, and claims priority under 35 U.S.C. §120 on, U.S. application Ser. No. 13/759,668, filed Feb. 5, 2013, which claims priority under 35 U.S.C. §120 on U.S. application Ser. No. 12/917,098, filed Nov. 1, 2010, now U.S. Pat. No. 8,388,089, which claims priority under 35 U.S.C. §119 on Japanese patent application no. 2009-259689, filed Nov. 13, 2009. The content of each such related application is incorporated by reference herein in its entirety.

BACKGROUND

1. Technical Field

The present invention relates to a printing device, a discharge test device and a discharge test method.

2. Related Art

Ink jet printers, which discharge ink and form an image on a medium, are used. Such printers form an image by discharging ink from nozzles. However when ink is not normally discharged from the nozzles, a desired image cannot be obtained.

JP-A-2003-53949 is an example of related art.

To prevent ink from not being discharged normally from nozzles, it may be determined whether or not there are abnormal nozzles in advance. In this determination, if erroneous determination occurs, a nozzle restore operation is performed and ink may be discharged and thrown away from nozzles erroneously determined to be abnormal. Therefore, it is desired that a nozzle test is not performed in an environment where erroneous determination occurs. On the other hand, even in an environment where erroneous determination occurs, there is a case in which ink can be discharged to perform printing. Because of the above, it is desirable to appropriately control the nozzle test and liquid discharge in accordance with the environment.

SUMMARY

An advantage of some aspects of the invention is to control the nozzle test and the liquid discharge in accordance with the environment.

According to aspects of the invention, a printing device or a discharge test device includes:

(A) a head that includes a nozzle discharging liquid to a medium, (B) a temperature obtaining section that obtains a temperature related to the head, (C) a missing-dot detecting section that detects whether or not the liquid is discharged from the nozzle, and (D) a control section that controls the head and the missing-dot detecting section so that:

(d1) when the temperature obtained by the temperature obtaining section is within a first temperature range, the head is configured to discharge the liquid to the medium and whether or not the liquid is discharged from the nozzle is detected, (d2) when the temperature obtained by the temperature obtaining section is outside the first temperature range and within a second temperature range, the head is configured to discharge the liquid to the medium and whether or not the liquid is discharged from the nozzle is not detected, and (d3) when the temperature obtained by the temperature obtaining section is outside the second temperature range, the liquid is not discharged to the medium and whether or not the liquid is discharged from the nozzle is not detected.

BRIEF DESCRIPTION OF THE DRAWINGS

The invention will be described with reference to the accompanying drawings, wherein like numbers reference like elements.

FIGS. 3A to 3C are diagrams showing a positional relationship between the head and a cap mechanism during a restore operation.

DESCRIPTION OF EXEMPLARY EMBODIMENTS

Figure 1A:
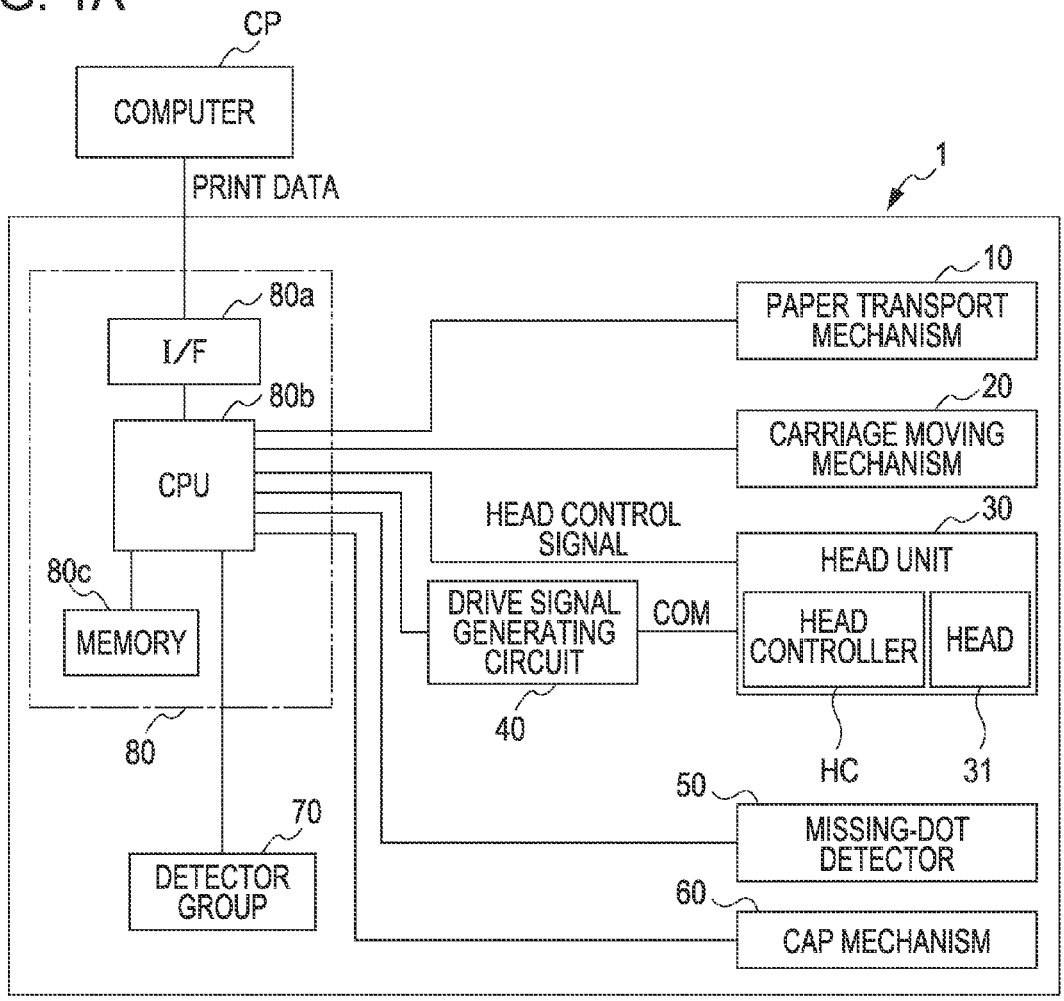
FIG. 1A is a block diagram for explaining a printing system including a printer and a computer CP.

At least the following item will be clarified by the description of this specification and the accompanying drawings.

A discharge test device including:

(A) a head that includes a plurality of nozzles discharging liquid to a medium, (B) a temperature obtaining section that obtains a temperature related to the head, (C) a detection electrode that faces the head with a predetermined distance therebetween, (D) an identification section that applies a predetermined voltage to the detection electrode and identifies an abnormal nozzle on the basis of voltage change of the detection electrode generated by liquid discharge from the nozzles, and (E) a control section that controls the head and the identification section so that:

(e1) when the temperature obtained by the temperature obtaining section is within a first temperature range, the head discharges the liquid to the medium after the identification section identifies the abnormal nozzle, (e2) when the temperature obtained by the temperature obtaining section is outside the first temperature range and within a second temperature range that is larger than the first temperature range, the head discharges the liquid to the medium without the abnormal nozzle being identified by the identification section, and (e3) when the temperature obtained by the temperature obtaining section is outside the second temperature range, the abnormal nozzle is not identified and the liquid is not discharged to the medium.

In this way, it is possible to appropriately control the nozzle test and the liquid discharge in accordance with the environment.

In the discharge test device, it is desired that, when the control section identifies the abnormal nozzle, the control section discharges the liquid to an object other than the medium from the abnormal nozzle and performs an operation to restore the abnormal nozzle to a normal nozzle. It is desired that the identification section detects the voltage change of the detection electrode generated by the liquid discharge from the nozzles and identifies a nozzle where the voltage change of the detection electrode is smaller than or equal to a predetermined value as an abnormal nozzle. It is desirable to determine that the temperature obtaining section fails when the temperature obtained by the temperature obtaining section is outside the second temperature range. It is desired that, when the temperature obtained by the temperature obtaining section is within the first temperature range, the control section further performs a mechanical abnormality check of the discharge test device, and when there is a mechanical abnormality, the control section does not identify the abnormal nozzle and does not discharge the liquid to the medium.

It is desired that, when the temperature obtained by the temperature obtaining section is within the first temperature range, the control section performs an electrical abnormality check of the discharge test device, and when there is the electrical abnormality, the control section does not identify the abnormal nozzle and does not discharge the liquid to the medium. When the temperature obtained by the temperature obtaining section is outside the second temperature range, it is desirable to display a warning indicating that there is a risk that the liquid is not normally discharged from the head.

In this way, it is possible to appropriately control the nozzle test and the liquid discharge in accordance with the environment.

A discharge test method including:

obtaining a temperature related to a head including a plurality of nozzles that discharge liquid to a medium, applying a predetermined voltage to a detection electrode when the temperature is within a first temperature range, and discharging liquid from the head to a medium after identifying an abnormal nozzle on the basis of voltage change of the detection electrode generated by liquid discharge from the nozzles, discharging liquid from the head to the medium without identifying the abnormal nozzle when the temperature is outside the first temperature range and within a second temperature range that is larger than the first temperature range, and identifying no abnormal nozzle and discharging no liquid to the medium when the temperature is outside the second temperature range.

In this way, it is possible to appropriately control the nozzle test and the liquid discharge in accordance with the environment.

About Ink Jet Printer

An embodiment will be described using an ink jet printer (hereinafter, printer 1) as an example.

Figure 1B:
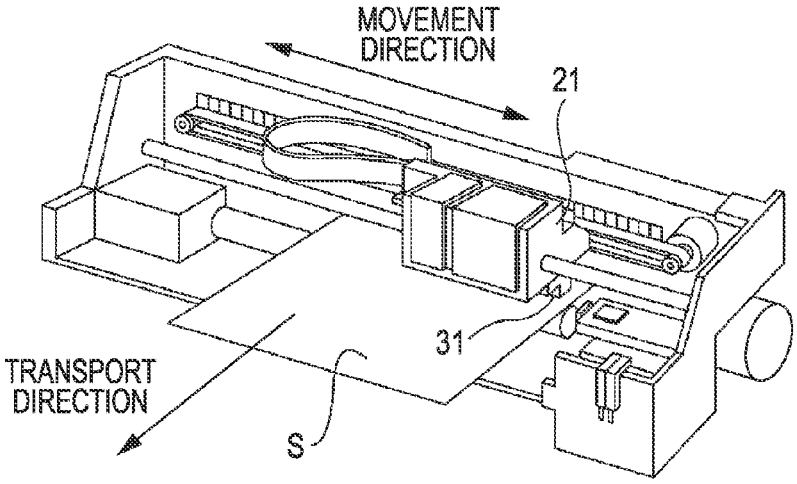
FIG. 1B is a perspective view of the printer.

FIG. 1A is a block diagram for explaining a printing system including the printer 1 and a computer CP, and FIG. 1B is a perspective view of the printer 1. The printer 1 discharges ink that is a kind of liquid to a medium such as a paper sheet, a cloth, or a film. The computer CP is communicably connected to the printer 1. The computer CP transmits print data of an image to the printer to cause the printer 1 to print the image. Printer 1 includes a paper transport mechanism 10, a carriage moving mechanism 20, a head unit 30, a drive signal generating circuit 40, a missing-dot detector 50, a cap mechanism 60, a detector group 70, and a controller 80.

The paper transport mechanism 10 transports a paper sheet in a transport direction. The carriage moving mechanism 20 moves a carriage 21 on which the head unit 30 is mounted in a movement direction (perpendicular to the transport direction).

The head unit 30 includes a head 31 and a head controller HC. The head 31 discharges ink to a paper sheet. The head controller HC controls the head 31 on the basis of a head control signal from the controller 80.

Figure 2A:
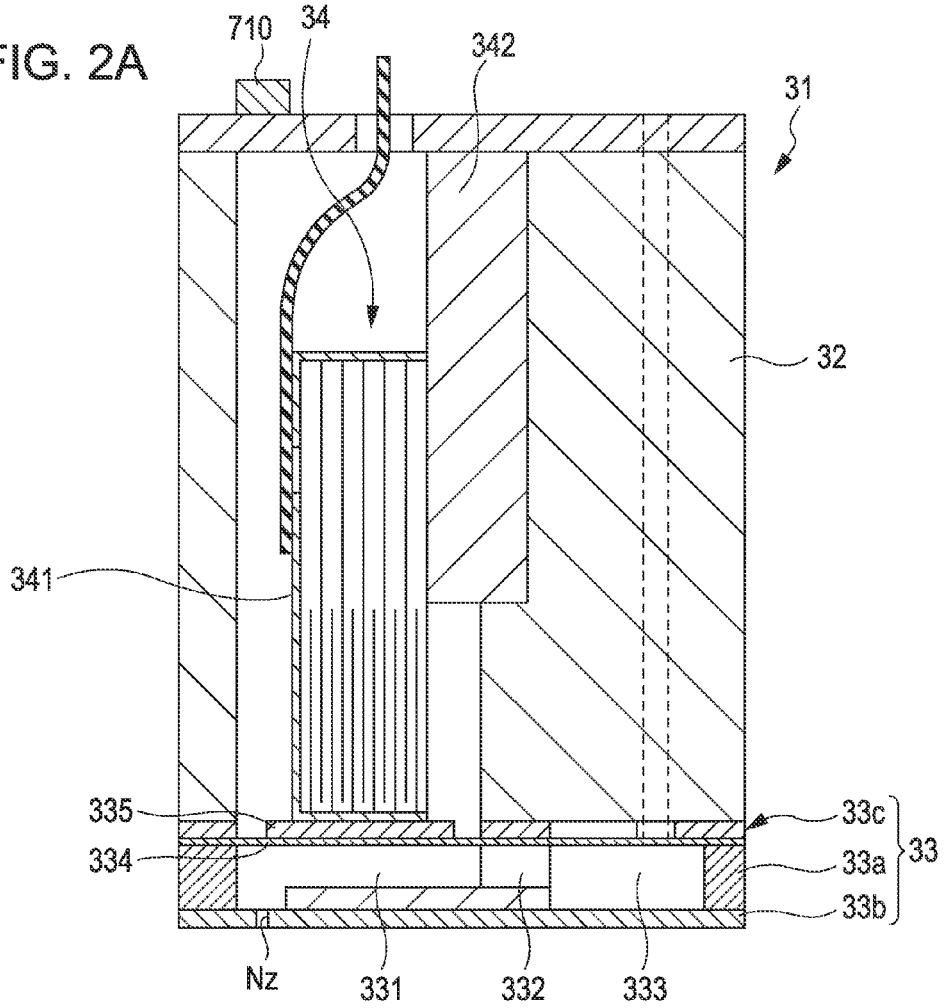
FIG. 2A is a cross-sectional view of a head.

FIG. 2A is a cross-sectional view of the head 31. The head 31 includes a case 32, a flow path unit 33, and a piezoelectric element unit 34. The case 32 is a member for holding and fixing a piezoelectric element PZT and the like, and for example, made of a non-conductive resin material such as an epoxy resin.

The flow path unit 33 includes a flow path forming substrate 33*a*, a nozzle plate 33*b*, and a vibration plate 33*c*. The nozzle plate 33*b* is bonded to one surface of the flow path forming substrate 33*a* and the vibration plate 33*c* is bonded to the other surface of the flow path forming substrate 33*a*. Voids and channels that form a pressure chamber 331, an ink supply path 332, and a common ink chamber 333 are formed on the flow path forming substrate 33*a*. The flow path forming substrate 33*a* is made of, for example, a silicon substrate. A nozzle group including a plurality of nozzles Nz is provided in the nozzle plate 33*b*. The nozzle plate 33*b* is made of a conductive plate member, for example, a thin metal plate. The nozzle plate 33*b* is connected to a ground line and has a ground potential. A diaphragm section 334 is provided to a portion on the vibration plate 33*c* corresponding to each pressure chamber 331. The diaphragm section 334 is deformed by the piezoelectric element PZT and changes the volume of the pressure chamber 331. The piezoelectric element PZT and the nozzle plate 33*b* are electrically insulated by the vibration plate 33*c*, a bonding layer, and the like lying therebetween.

The piezoelectric element unit 34 includes a piezoelectric element group 341 and a fixed plate 342. The piezoelectric element group 341 has a comb teeth shape. Each of the comb teeth is the piezoelectric element PZT. The top surface of each piezoelectric element PZT is bonded to an island section 335 included in the corresponding diaphragm section 334. The fixed plate 342 supports the piezoelectric element group 341 and is a mounting portion of the case 32. The piezoelectric element PZT is a kind of an electromechanical conversion element, and when the drive signal COM is applied, the piezoelectric element is expanded or contracted in the longitudinal direction and provides a pressure change to the liquid in the pressure chamber 331. The pressure change is generated in the liquid in the pressure chamber 331 owing to a volume change of the pressure chamber 331. By using this pressure change, an ink droplet can be discharged from the nozzle Nz.

A thermistor 710 (included in the detector group 703) is attached to an upper portion of the head 31. The thermistor 710 is connected to the controller 80, so that the controller 80 can obtain a temperature of the head 31.

Figure 2B:
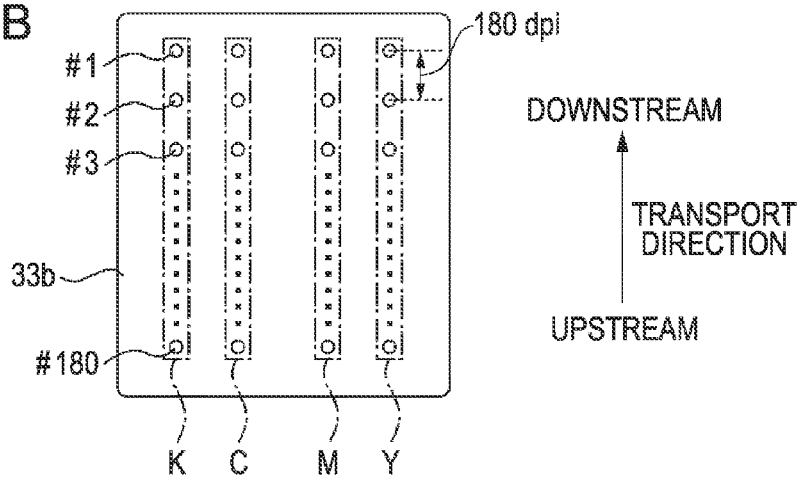
FIG. 2B is a diagram showing an array of nozzles (Nz) provided in a nozzle plate.

FIG. 2B is a diagram showing an array of nozzles (Nz) provided in the nozzle plate 33*b*. In the nozzle plate, a plurality of nozzle rows, each of which includes 180 nozzles (#1 to #180) arranged at an interval of 180 dpi along the transport direction of a paper sheet, are provided. Each nozzle row discharges ink of a color different from each other, and four nozzle rows are provided in the nozzle plate 33*b*. Specifically, the nozzle rows include a black ink nozzle row K, a cyan ink nozzle row C, a magenta ink nozzle row M, and a yellow ink nozzle row Y.

The drive signal generating circuit 40 generates the drive signal COM. When the drive signal COM is applied to the piezoelectric element PZT, the piezoelectric element is expanded or contracted, so that the volume of the pressure chamber 331 corresponding to each nozzle Nz changes. Therefore, the drive signal COM is applied to the head 31 when performing a printing operation, a missing-dot test (described below), and a flushing operation that is a restore operation of a nozzle causing a missing dot.

The missing-dot detector 50 detects whether or not ink is discharged from each nozzle Nz. The cap mechanism 60 suppresses the evaporation of ink solvent from the nozzle Nz and performs a sucking operation to suck in ink from each nozzle Nz so as to recover a discharge capability of the nozzle Nz. The detector group 70 includes a plurality of detectors for monitoring the status of the printer 1. The detection results of the detectors are outputted to the controller 80.

The controller 80 performs an entire control of the printer 1, and includes an interface section 80*a*, a CPU 80*b*, and a memory 80*c*. The interface section 80*a* transmits and receives data to and from the computer CP. Memory 80*c* secures an area to store a computer program, a work area, and the like. The CPU 80*b* controls each component to be controlled (the paper transport mechanism 10, the carriage moving mechanism 20, the head unit 30, the drive signal generating circuit 40, the missing-dot detector 50, the cap mechanism 60, and the detector group 70) in accordance with the computer program stored in the memory 80*c*.

In the printer 1, dot forming processing to form dots on a paper sheet by intermittently discharging ink from the head 31 moving along the movement direction of the carriage, and transport processing to transport the paper sheet in the transport direction are repeatedly performed. As a result, dots are formed in a position different from the position where dots are formed by the previous dot forming processing, so that a two-dimensional image is formed on the medium.

Discharge Test and Restore Operation

The nozzle may be clogged if ink (liquid) is not discharged from the nozzle for a long time or a foreign object such as paper powder is attached to the nozzle. If the nozzle is clogged, ink is not discharged when the ink should be discharged from the nozzle, and thus a phenomenon (missing dot) in which a dot is not formed at a position where the dot should be formed occurs. When the "missing dot" occurs, image quality deteriorates. Therefore, in this embodiment, when a nozzle of missing-dot is detected as a result of "discharge test" performed by the missing-dot detector 50, "restore operation" is performed so that ink is normally discharged from the nozzle of missing dot.

It is preferable that the missing-dot test is performed immediately after the printer 1 is turned on, or when the printer 1 receives print data from the computer CP and starts printing. Or, the missing-dot test may be performed every predetermined time in long time printing. Hereinafter, the restore operation of the nozzle of missing dot will be described, and then the discharge test will be described.

Restore Operation

FIGS. 3A to 3C are diagrams showing a positional relationship between the head 31 and the cap mechanism 60 during the restore operation. First, the cap mechanism 60 will be described. The cap mechanism 60 includes a cap 61 and a slider member 62 that supports the cap 61 and can move in an obliquely vertical direction. The cap 61 includes a rectangular bottom section (not shown in the figures) and a side wall section 611 standing on peripheral edges of the bottom section, and has a thin box shape whose upper surface facing the nozzle plate 33*b* is open. A sheet-shaped moisture retaining member made of a porous material such as felt or sponge is disposed in a space surrounded by the bottom section and the side wall section 611.

As shown in FIG. 3A, when the carriage 21 is apart from a home position (here, right in the movement direction), the cap 61 is located sufficiently lower than the surface of the nozzle plate 33*b* (hereinafter, also referred to as nozzle surface). As shown in FIG. 3B, when the carriage 21 moves toward the home position, the carriage 21 comes into contact with a contact section 63 provided on the slider member 62, and the contact section 63 moves toward the home position along with the carriage 21. When the contact section 63 moves toward the home position, the slider member 62 rises along a guiding long hole 64, and the cap 61 also rises along with the slider member 62. Finally, as shown in FIG. 3C, when the carriage 21 is located at the home position, the side wall section 611 (porous material) of the cap 61 is closely attached to the nozzle plate 33*b*. Therefore, it is possible to suppress the evaporation of ink solvent from the nozzle by positioning the carriage 21 at the home position when the printer 1 is turned off or not used for a long time.

Next, the restore operation will be described. There is "flushing operation" as one of restore operations of a nozzle of missing dot. As shown in FIG. 3B, the flushing operation is an operation in which an ink droplet is forcibly and continuously discharged from each nozzle and clogs in the nozzles are removed when there is a certain gap between the nozzle surface and opening edges of the cap 61.

A waste liquid tube 65 is disposed in a space between the bottom surface of the cap 61 and the side wall section 611, and a suction pump (not shown in the figures) is connected to a halfway portion of the waste liquid tube 65. As one of the other restore operations, "pump suction" is performed when the opening edges of the cap 61 are in contact with the nozzle surface as shown in FIG. 3C. If the suction pump is operated when the side wall section 611 of the cap 61 is in contact with the nozzle surface, the space in the cap 61 can be under negative pressure. In this way, it is possible to suck ink from the head 31 along with thickened ink and paper powder, so that the nozzle of missing dot can be restored.

As another restore operation, by moving the carriage 21 in the movement direction while the cap mechanism 60 is held in the position shown in FIG. 3B, ink droplets and foreign objects attached to the nozzle surface are removed by a wiper 66 protruded upward from the side wall section 611 of the cap 61. As a result, ink can be normally discharged from nozzles that were clogged by foreign objects.

About Missing-Dot Detector 50

Figure 4:
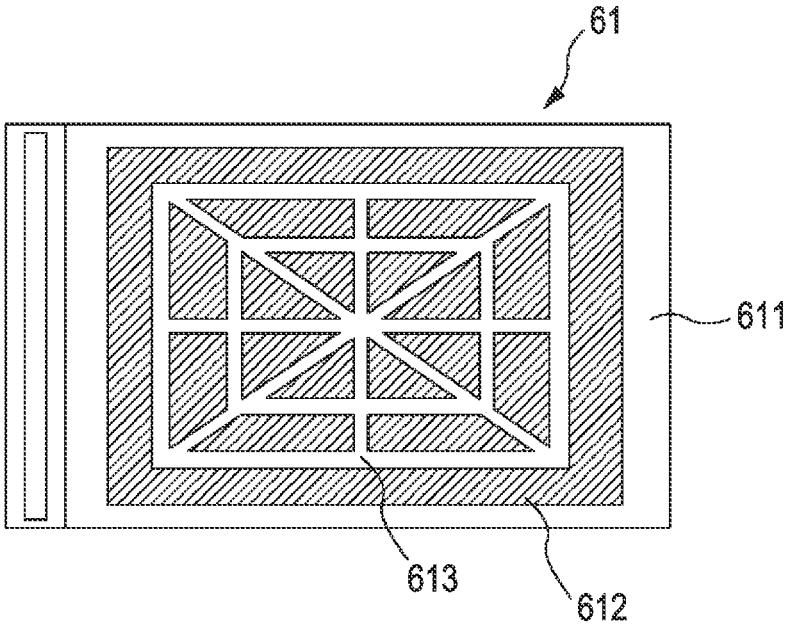
FIG. 4 is a view of the cap seen from the above.
Figure 5A:
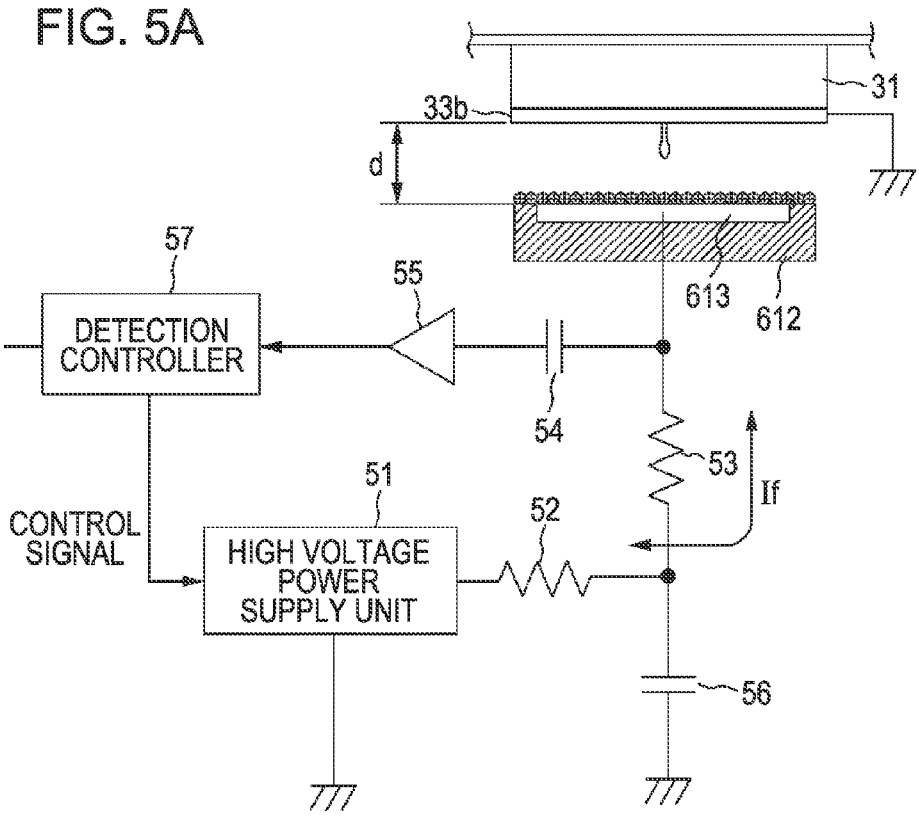
FIG. 5A is a diagram for explaining a missing-dot detector.
Figure 5B:
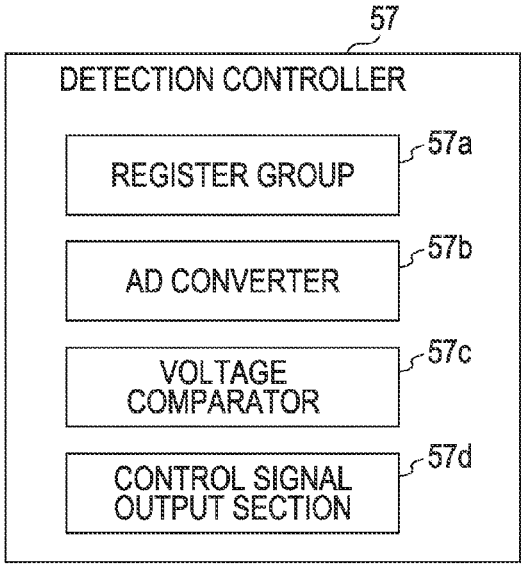
FIG. 5B is a block diagram for explaining a detection controller.

FIG. 4 is a view of the cap 61 seen from the above, FIG. 5A is a diagram for explaining the missing-dot detector 50, and FIG. 5B is a block diagram for explaining a detection controller 57. The missing-dot detector 50 actually discharges ink from each nozzle, checks whether the ink is discharged normally or not, and thus detects a nozzle of missing dot. First, a configuration of the missing-dot detector 50 will be described. As shown in FIG. 5A, the missing-dot detector 50 includes a high voltage power supply unit 51, a first limiting resistance 52, a second limiting resistance 53, a detecting capacitor 54, an amplifier 55, a smoothing capacitor 56, and a detection controller 57.

When missing-dot detection is performed, as shown in FIGS. 3B and 5A, the nozzle surface and the cap 61 face each other with a predetermined gap d therebetween. As shown in FIG. 4, in a space surrounded by the side wall section 611 of the cap 61, a moisture retaining member 612 and a wire-shaped detection electrode 613 are arranged. When the missing-dot detection is performed, the detection electrode 613 shows a high voltage of about 600 V to 1 kV. The detection electrode 613 illustrated in FIG. 4 includes a frame section having a double-line rectangular shape, a diagonal section connecting opposing corners of the frame section, and a cross section connecting the centers of each side of the frame section. Based on this structure, the detection electrode 613 is electrostatically charged uniformly over a large area. The ink solvent of this embodiment is a liquid (for example, water) having electrical conductivity, and when a high voltage is applied to the detection electrode 613 while the moisture retaining member 612 is wet, the surface of the moisture retaining member 612 shows the same voltage. Because of this, an area to which ink is discharged from the nozzles is electrostatically charged uniformly over a large area.

The high voltage power supply unit 51 is a kind of power supply that applies a predetermined voltage to the detection electrode 613 in the cap 61. The high voltage power supply unit 51 according to this embodiment includes a DC power supply of around 600 V to 1 kV, and an operation of the high voltage power supply unit 51 is controlled by a control signal from the detection controller 57.

The first limiting resistance 52 and the second limiting resistance 53 are arranged between an output terminal of the high voltage power supply unit 51 and the detection electrode 613, and limit an electric current flowing between the high voltage power supply unit 51 and the detection electrode 613. In this embodiment, the first limiting resistance 52 and the second limiting resistance 53 have the same resistance value (for example, 1.6 MΩ), and the first limiting resistance 52 and the second limiting resistance 53 are connected in series. As shown in FIG. 5, one terminal of the first limiting resistance 52 is connected to the output terminal of the high voltage power supply unit 51, the other terminal of the first limiting resistance 52 is connected to one terminal of the second limiting resistance 53, and the other terminal of the second limiting resistance 53 is connected to the detection electrode 613.

The detecting capacitor 54 is an element for extracting a voltage change component of the detection electrode 613. One conductor of the detecting capacitor 54 is connected to the detection electrode 613, and the other conductor of the detecting capacitor 54 is connected to the amplifier 55. By disposing the detecting capacitor 54 between the detection electrode 613 and the amplifier 55, it is possible to eliminate a bias component (DC component) of the detection electrode 613 and facilitate handling of the signal. In this embodiment, the capacitance of the detecting capacitor 54 is 4700 pF.

The amplifier 55 amplifies a signal (voltage change) appearing at the other terminal of the detecting capacitor 54 and outputs the amplified signal. The amplifier 55 according to this embodiment has a gain of 4000. Based on this, the voltage change component can be obtained as a voltage signal having amplitude of around 2 to 3 V. A pair of the detecting capacitor 54 and the amplifier 55 corresponds to a kind of detector, and detects an electrical change which is generated in the detection electrode 613 when an ink droplet is discharged.

The smoothing capacitor 56 suppresses an abrupt change of voltage. One terminal of the smoothing capacitor of this embodiment is connected to a signal line connecting the first limiting resistance 52 and the second limiting resistance 53, and the other terminal is connected to the ground. The capacitance of the smoothing capacitor 56 is 0.1 μF.

The detection controller 57 is a section for controlling the missing-dot detector 50. As shown in FIG. 5B, the detection controller 57 includes a register group 57*a*, an AD converter 57*b*, a voltage comparator 57*c*, and a control signal output section 57*d*. The register group 57*a* includes a plurality of registers. A determination result of each nozzle Nz and a voltage threshold value for determination are stored in the registers. The AD converter 57*b* converts the amplified voltage signal (analog values) outputted from the amplifier 55 into digital values. The voltage comparator 57*c* compares a value of amplitude based on the amplified voltage signal with the voltage threshold value. The control signal output section 57*d* outputs a control signal for controlling the high voltage power supply unit 51.

About Discharge Test

In the printer 1, the nozzle plate 33*b* is connected to the ground and the ground voltage is applied to the nozzle plate 33*b*, and a high voltage of about 600 V to 1 kV is applied to the detection electrode 613 disposed in the cap 61. The ink droplet discharged from the nozzle is set to the ground voltage by the nozzle plate of the ground voltage. The nozzle plate 33*b* and the detection electrode 613 are faced each other with a predetermined gap d therebetween (refer to FIG. 5A), and an ink droplet is discharged from the nozzle where the voltage change will be detected. The detection controller 57 obtains an electrical change generated in the detection electrode 613 owing to the discharge of the ink droplet via the detecting capacitor 54 and the amplifier 55 as a voltage signal SG. The detection controller 57 determines whether or not the ink droplet is discharged normally from the nozzle where the voltage change will be detected on the basis of the amplitude value (voltage change) of the voltage signal SG.

The principle of the detection is based on the fact that the nozzle plate 33*b* and the detection electrode 613 are arranged with a predetermined gap d therebetween, so that the nozzle plate 33*b* and the detection electrode 613 behave as if they were a capacitor. As shown in FIG. 5A, the ink elongated into a columnar shape (ink column) from the nozzle Nz comes into contact with the nozzle plate 33*b* connected to the ground, so that the ink column is set to the ground voltage. The elongation of the ink changes the electrostatic capacitance of the capacitor. Specifically, when the ink is discharged from the nozzle, the ink of the ground voltage and the detection electrode 613 constitute a capacitor, and the electrostatic capacitance changes.

When the electrostatic capacitance decreases, an amount of charge that can be accumulated between the nozzle plate 33*b* and the detection electrode 613 decreases. Therefore, surplus charge moves from the detection electrode 613 to the high voltage power supply unit 51 through the limiting resistances 52 and 53. In other words, an electric current flows toward the high voltage power supply unit 51. On the other hand, when the electrostatic capacitance increases or the decreased electrostatic capacitance returns to the original state, the charge moves from the high voltage power supply unit 51 to the detection electrode 613 through the limiting resistances 52 and 53. In other words, an electric current flows toward the detection electrode 613. When such electric currents (for convenience, also referred to as discharge test current If) flow, the voltage of the detection electrode 613 changes. The voltage change of the detection electrode 613 also appears as a voltage change of the other conductor (conductor connected to the amplifier 55) of the detecting capacitor 54. Therefore, it is possible to determine whether or not an ink droplet is discharged by monitoring the voltage change of the other conductor.

Figure 6A:
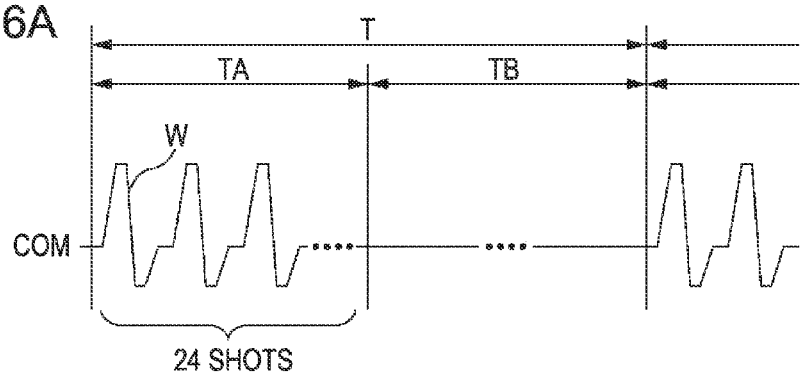
FIG. 6A is a diagram showing an example of a drive signal COM used in a discharge test.
Figure 6B:
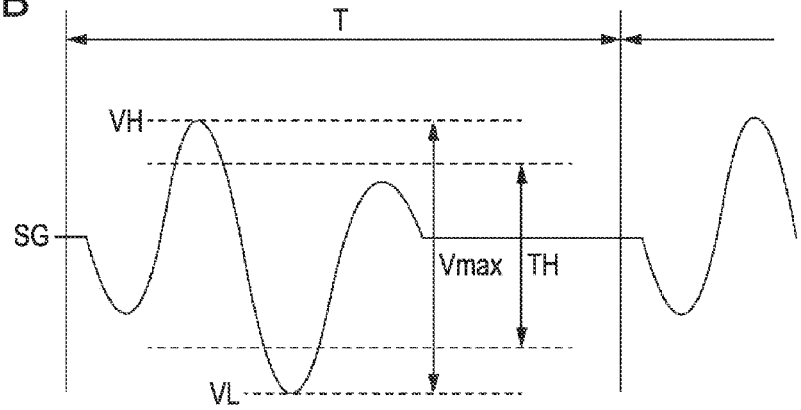
FIG. 6B is a diagram for explaining a voltage signal SG outputted from an amplifier when ink is discharged from a nozzle by the drive signal COM.
Figure 6C:
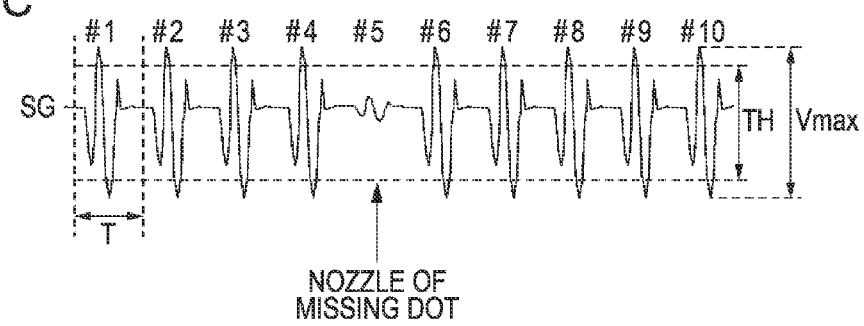
FIG. 6C is a diagram showing the voltage signal SG that is a result of the discharge test of a plurality of nozzles.

FIG. 6A is a diagram showing an example of the drive signal COM used in the discharge test, FIG. 6B is a diagram for explaining the voltage signal SG outputted from the amplifier 55 when ink is discharged from a nozzle by the drive signal COM, and FIG. 6C is a diagram showing the voltage signal SG that is a result of the discharge test of a plurality of nozzles (#1 to #10). The drive signal COM includes a plurality of drive waveforms W (for example, 24 drive waveforms) for discharging ink from a nozzle in the first half period TA of a repetition period T, and a certain voltage is maintained at a medium voltage level in the second half period TB. The drive signal generating circuit 40 repeatedly generates the plurality of drive waveforms W (24 drive waveforms) every repetition period T. The repetition period T corresponds to the time required to perform a test of one nozzle.

The drive signal COM is applied to a piezoelectric element corresponding to a certain nozzle among the nozzles to be tested over the repetition period T. Then, ink droplets are continuously discharged from the nozzle to be tested in the first half period TA (for example, 24 shots are discharged). In this way, the voltage of the detection electrode 613 changes, and the amplifier 55 outputs the voltage change to the detection controller 57 as the voltage signal SG (sine curve) shown in FIG. 6B. Since the amplitude of the voltage signal SG obtained with one shot of ink droplet is small, ink droplets are continuously discharged from the nozzle, so that the voltage signal SG having sufficient amplitude to perform the test can be obtained.

The detection controller 57 calculates a maximum amplitude Vmax (difference between a maximum voltage VH and a minimum voltage VL) from the voltage signal SG of the nozzle to be tested during the test period (T), and compares the maximum amplitude Vmax and a predetermined threshold value TH. When ink is discharged from the nozzle to be tested in accordance with the drive signal COM, the voltage of the detection electrode 613 changes and the maximum amplitude Vmax of the voltage signal SG becomes greater than the threshold value TH. On the other hand, if ink is not discharged from the nozzle to be tested due to clogs or the like, or if an amount of discharged ink is small, the voltage of the detection electrode 613 does not change, or the voltage change is small, so that the maximum amplitude Vmax of the voltage signal SG becomes smaller than or equal to the threshold value TH.

After the drive signal COM is applied to a piezoelectric element corresponding to a certain nozzle, the drive signal COM is applied to a piezoelectric element corresponding to the next nozzle to be tested over the repetition period T. In such a way, for every nozzle to be tested, the drive signal COM is applied to a piezoelectric element corresponding to the nozzle over the repetition period T. As a result, as shown in FIG. 6C, the detection controller 57 can obtain the voltage signal SG in which a voltage change of sine curve occurs for each repetition period T.

For example, from the result of FIG. 6C, the detection controller 57 determines that the nozzle #5 is a missing-dot nozzle (abnormal nozzle) because the maximum amplitude Vmax of the voltage signal SG corresponding to the test period of the nozzle #5 is smaller than the threshold value TH. The detection controller 57 determines that the other nozzles (#1 to #4, 6 to #10) are normal nozzles because the maximum amplitudes Vmax of the voltage signal SG corresponding to the test periods of the other nozzles are greater than or equal to the threshold value TH.

Figure 7:
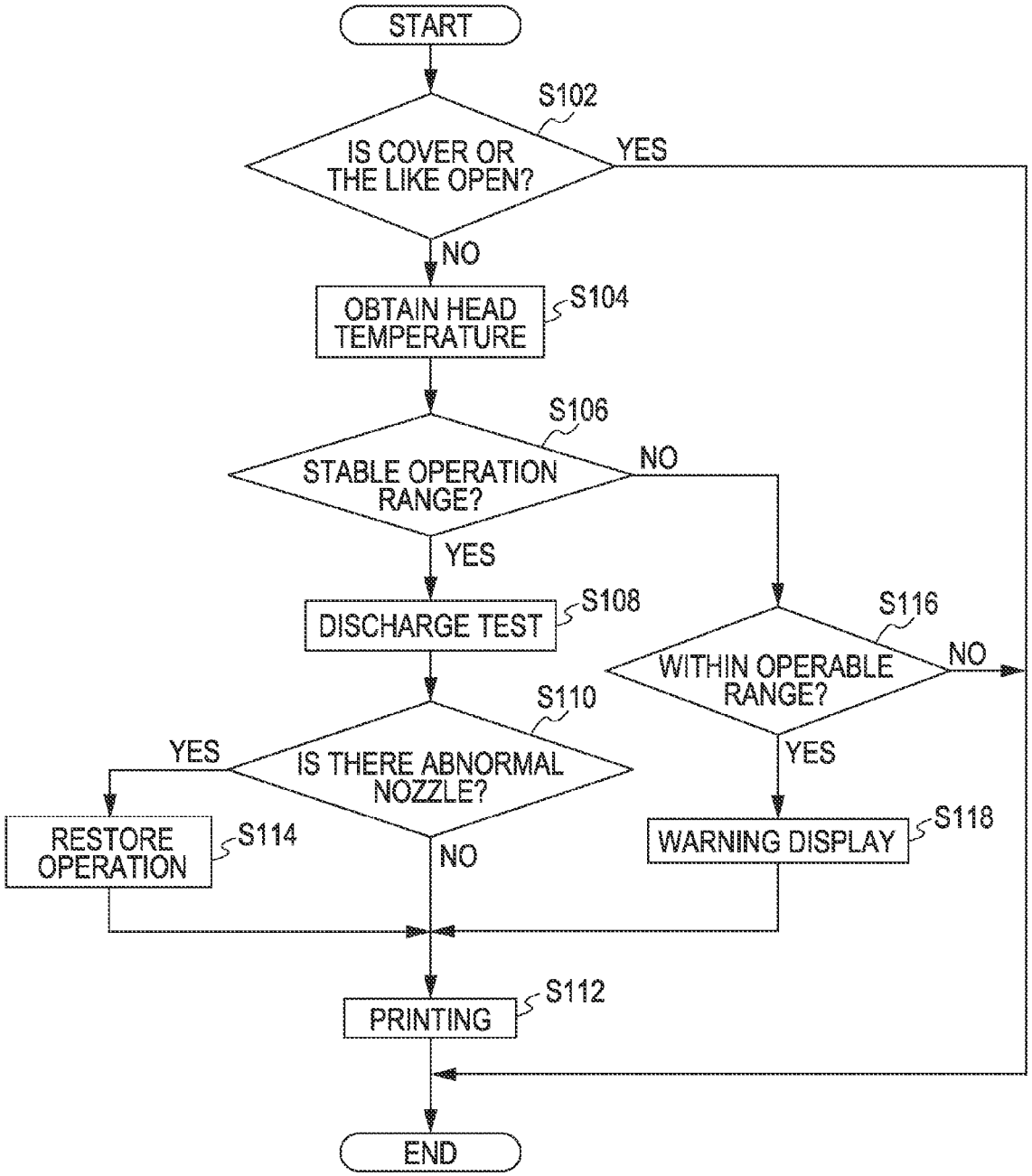
FIG. 7 is a flowchart for explaining print processing according to an embodiment.

FIG. 7 is a flowchart for explaining print processing according to this embodiment.

When the discharge test starts, first, it is determined whether or not a cover (not shown in the figures) of the printer is open (S102). The reason why it is determined whether or not the cover is open is because a high voltage is applied to the electrode in the discharge test as described above, and in such a time if the cover is open, a user may touch the high voltage electrode. A sensor not shown in the figures is provided in the printer 1 so as to determine whether or not the cover of the printer 1 is open.

In step S102, the determination is not limited to whether or not the cover is open. For example, in step S102, it may be determined whether or not a waste liquid tank is open, whether or not a cartridge lever that fixes an ink cartridge is released, whether or not the printer 1 is turned off, whether or not an error occurs in a program operating the printer 1, and so on.

The determination whether or not the cover of the printer 1 is open, the determination whether or not the waste liquid tank is open, and the determination whether or not the cartridge lever is released as described above correspond to a determination with respect to mechanical abnormality. The determination whether or not the printer 1 is turned off and the determination whether or not an error occurs in the program operating the printer 1 correspond to a determination with respect to electrical abnormality.

In step S102, when a mechanical abnormality or an electrical abnormality occurs, the discharge test cannot be performed, and thus the process ends.

On the other hand, in step S102, when a mechanical abnormality and an electrical abnormality do not occur, a head temperature is obtained (S104). The temperature of the head 31 is obtained by the controller 80 connected to the above-mentioned thermistor 710.

Next, it is determined whether or not the obtained temperature of the head 31 is within a range of stable operation of the head 31 (S106). Here, the range of stable operation of the head 31 is set to a range of temperature that is higher than or equal to 10° C. and lower than 40° C. When the obtained temperature of the head 31 is higher than or equal to 10° C. and lower than 40° C., the nozzle discharge test is performed (S108). The discharge test has been described above, so that the description will be omitted.

After the discharge test is performed, whether or not there are abnormal nozzles is determined (S110). When the there is at least one abnormal nozzle, the nozzle restore operation (S114) is performed. The method of the nozzle restore operation has been described above, so that the description will be omitted. After the nozzle restore operation (S114) is performed, printing is performed (S112).

On the other hand, when the there is no abnormal nozzle in step S110, printing is performed (S112).

In this way, when the there are abnormal nozzles, it is possible to perform printing after performing the nozzle restore operation to restore abnormal nozzles to normal nozzles.

In step S106, when the obtained temperature of the head 31 is outside the range of stable operation (specifically, higher than or equal to 10° C. and lower than 40° C.), it is further determined whether or not the temperature of the head 31 is within an operable range (S116). Here, the operable range is a range of temperature that is higher than or equal to 0° C. and lower than 10° C. and a range of temperature that is higher than or equal to 40° C. and lower than 50° C. When the obtained temperature of the head 31 is within the operable range, a warning is displayed on the printer 1 (S118).

The warning displayed here is a warning indicating that, for example, although ink can be discharged, it cannot be guaranteed that ink droplets of an appropriate size are discharged. After such a warning is displayed, the printing is performed (S112). In this way, it is possible to perform printing while notifying a user that ink can be discharged, but print quality is out of guarantee.

When the temperature of the head 31 is out of the operable range (specifically, lower than 0° C., or higher than or equal to 50° C.) in step S116, the process ends without performing printing. When the head temperature is out of the operable range, it is very difficult to discharge ink from the head 31. Thus, by doing the above operation, a useless printing operation can be avoided. When it is determined that the temperature of the head 31 is out of the operable range in step S116, it may be determined that the thermistor 710 that obtains the temperature of the head 31 fails.

By the way, the discharge test described above is a test in which ink is discharged from the head 31 and it is determined whether or not a nozzle is an abnormal nozzle in accordance with a degree of discharge. Therefore, if the discharge test is performed when the head 31 is outside the range of stable operation and ink may not be appropriately discharged from the head 31, a normal nozzle may be determined to be an abnormal nozzle. In other words, the discharge test may make a false determination. However, in this embodiment, as described above, when the head 31 is outside the range of stable operation, the discharge test is not performed, so that the discharge test does not make a false determination.

If the restore operation is performed under a situation in which a normal nozzle may be erroneously determined to be an abnormal nozzle, the restore operation may be performed on a normal nozzle and waste ink. However, in this embodiment, the discharge test is performed only when the temperature of the head 31 is within the range of stable operation, and then the restore operation is performed, so that the discharge test is performed in a situation in which there is no false determination, and thus ink can be prevented from being wasted.

In this way, it is possible to appropriately control the discharge test and printing in accordance with the environment.

Other Embodiments

Although the printer 1 is described as the discharge test device in the above embodiment, the embodiment is not limited to this, and the discharge test device may be incorporated in a liquid discharge device that ejects or discharges fluid other than ink (liquid, a liquid body in which functional material particles are dispersed, and a fluid body such as gel). For example, the same technique as that of the above embodiment may be applied to various devices to which an ink jet technique is applied. Such devices include a color filter manufacturing device, a dyeing device, a microprocessing device, a semiconductor manufacturing device, a surface processing device, a three-dimensional molding device, a vaporizer, an organic EL manufacturing device (particularly, a polymer EL manufacturing device), a display manufacturing device, a deposition device, and a DNA chip manufacturing device. Methods and manufacturing methods performed in such devices are also within the scope of application of the invention.

The above embodiments are intended for easier understanding of the invention and do not limit the interpretation of the invention. Needless to say, the invention may be modified and improved without departing from the scope of the invention and the invention includes equivalents thereof.

What is claimed is:

1. A printing device comprising:

(A) a head that includes a nozzle discharging liquid to a medium, (B) a temperature obtaining section that obtains a temperature related to the head, (C) a missing-dot detecting section that detects whether or not the liquid is discharged from the nozzle, and (D) a control section that controls the head and the missing-dot detecting section so that:

(d1) when the temperature obtained by the temperature obtaining section is within a first temperature range, the head is configured to discharge the liquid to the medium and whether or not the liquid is discharged from the nozzle is detected, (d2) when the temperature obtained by the temperature obtaining section is outside the first temperature range and within a second temperature range, the head is configured to discharge the liquid to the medium and whether or not the liquid is discharged from the nozzle is not detected, and (d3) when the temperature obtained by the temperature obtaining section is outside the second temperature range, the liquid is not discharged to the medium and whether or not the liquid is discharged from the nozzle is not detected.

2. The printing device according to claim 1, wherein, when the missing-dot detecting section detects that the liquid is not discharged from the nozzle, the control section performs an operation to restore the nozzle.

3. The printing device according to claim 1, wherein when the temperature obtained by the temperature obtaining section is outside the second temperature range, it is determined that the temperature obtaining section fails.

4. The printing device according to claim 1, wherein when the temperature obtained by the temperature obtaining section is within the first temperature range, the control section further performs a mechanical abnormality check of the printing device, and when there is a mechanical abnormality, the control section does not detect whether or not the liquid is discharged from the nozzle and does not discharge the liquid to the medium.

5. The printing device according to claim 1, wherein when the temperature obtained by the temperature obtaining section is within the first temperature range, the control section further performs an electrical abnormality check of the printing device, and when there is an electrical abnormality, the control section does not detect whether or not the liquid is discharged from the nozzle and does not discharge the liquid to the medium.

6. The printing device according to claim 1, wherein when the temperature obtained by the temperature obtaining section is outside the second temperature range, a warning indicating that there is a risk that the liquid is not normally discharged from the head is displayed.

7. A discharge test method comprising:

obtaining a temperature related to a head including a nozzle that discharges liquid to a medium, applying a discharge of the liquid to the medium and detecting whether or not the liquid is discharged from the nozzle when the temperature is within a first temperature range, not detecting whether or not the liquid is discharged from the nozzle when the temperature is outside the first temperature range and within a second temperature range, and not discharging the liquid to the medium and not detecting whether or not the liquid is discharged from the nozzle when the temperature is outside the second temperature range.

8. A discharge test device comprising:

(A) a head that includes a nozzle discharging liquid to a medium, (B) a temperature obtaining section that obtains a temperature related to the head, (C) a missing-dot detecting section that detects whether or not the liquid is discharged from the nozzle, and (D) a control section that controls the head and the missing-dot detecting section so that:

(d1) when the temperature obtained by the temperature obtaining section is within a first temperature range, the head is configured to discharge the liquid to the medium and whether or not the liquid is discharged from the nozzle is detected, (d2) when the temperature obtained by the temperature obtaining section is outside the first temperature range and within a second temperature range, the head is configured to discharge the liquid to the medium and whether or not the liquid is discharged from the nozzle is not detected, and (d3) when the temperature obtained by the temperature obtaining section is outside the second temperature range, the liquid is not discharged to the medium and whether or not the liquid is discharged from the nozzle is not detected.

* * * * *